US006942530B1

(12) United States Patent
Hall et al.

(10) Patent No.: US 6,942,530 B1
(45) Date of Patent: Sep. 13, 2005

(54) ENGINE CONTROL STRATEGY FOR A MARINE PROPULSION SYSTEM FOR IMPROVING SHIFTING

(75) Inventors: Ronald L. Hall, Stillwater, OK (US); A. DeWayne Sharpton, Stillwater, OK (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/763,156

(22) Filed: Jan. 22, 2004

(51) Int. Cl.[7] ..... B63H 21/22
(52) U.S. Cl. ..... 440/1; 477/101
(58) Field of Search ..... 440/1, 75; 477/101

(56) References Cited

U.S. PATENT DOCUMENTS

| | | | | |
|---|---|---|---|---|
| 4,262,622 | A | 4/1981 | Dretzka et al. | 440/1 |
| RE32,998 | E | 7/1989 | Davis | 440/75 |
| 4,843,914 | A | 7/1989 | Koike | 74/858 |
| 4,938,189 | A | 7/1990 | Morita et al. | 123/335 |
| 5,403,246 | A | 4/1995 | Umemoto | 477/101 |
| 5,692,992 | A | 12/1997 | Arvidsson et al. | 477/101 |
| 5,827,150 | A | 10/1998 | Mukumoto | 477/101 |
| 5,853,306 | A | 12/1998 | Worth et al. | 440/1 |
| 6,470,852 | B1 | 10/2002 | Kanno | 123/339.23 |
| 6,647,956 | B1 | 11/2003 | Sharpton | 123/339.1 |
| 6,659,911 | B2 | 12/2003 | Suzuki et al. | 477/109 |

*Primary Examiner*—Jesus D. Sotelo
(74) *Attorney, Agent, or Firm*—William D. Lanyi

(57) ABSTRACT

An engine control strategy for a marine propulsion system selects a desired idle speed for use during a shift event based on boat speed and engine temperature. In order to change the engine operating speed to the desired idle speed during the shift event, ignition timing is altered and the status of an idle air control valve is changed. These changes to the ignition timing and the idle air control valve are made in order to achieve the desired engine idle speed during the shift event. The idle speed during the shift event is selected so that the impact shock and resulting noise of the shift event can be decreased without causing the engine to stall.

18 Claims, 3 Drawing Sheets

IDLE SPEED = f(TEMPERATURE)

| TEMPERATURE | IDLE SPEED |
|---|---|
| -10° | 800 |
| 0° | 800 |
| 20° | 750 |
| 40° | 700 |
| 60° | 650 |
| 65° | 600 |
| 71° | 600 |
| 80° | 600 |
| 100° | 600 |

IDLE SPEED = f(BOAT SPEED)

| BOAT SPEED | IDLE SPEED |
|---|---|
| 0 | -100 |
| 2 | -50 |
| 4 | 0 |
| 6 | 50 |
| 8 | 100 |
| 10 | 200 |
| 12 | 200 |
| 14 | 200 |
| 16 | 200 |
| 18 | 200 |
| 20 | 200 |
| 25 | 200 |
| 30 | 200 |
| 35 | 200 |
| 40 | 200 |
| 50 | 200 |
| 60 | 200 |
| 70 | 200 |
| 80 | 200 |
| 90 | 200 |

ENGINE CONTROL STRATEGY FOR A MARINE PROPULSION SYSTEM FOR IMPROVING SHIFTING

BACKGROUND OF THE INVENTION

1. Field of the Invention

The present invention generally relates to a control system for an engine of a marine propulsion system and, more particularly, to a control system that improves the shifting process from neutral into either forward or reverse gear so that the impact of the shift event is minimized and the likelihood of stalling is decreased.

2. Description of the Prior Art

It is very well known to those skilled in the art of marine propulsion systems that shifting from one gear position to another can result in significant impact noise and impact shock to the drive unit. It is also well known to those skilled in the art that one method for alleviating these problems is to deprive one or more cylinders of the engine from an ignition spark during the shift event. This has the effect of slowing the operating speed of the engine and decreasing the torque provided by the engine to the drive train.

U.S. Pat. Re. 32,998, which issued to Davis on Jul. 25, 1989, discloses an ignition interrupt system with a stall interval. The spark ignition interrupt system is provided for a marine propulsion internal combustion engine to reduce engine speed and facilitate shifting of a marine propulsion transmission. Spark ignition is terminated in response to a given shift condition until engine speed drops below a given cut-in speed or until completion of the shifting, whichever occurs first. A stall interval is also started in response to the given shift condition. The engine is stalled upon completion of the stall interval if the shifting is not complete, even if engine speed has dropped below the given cut-in speed.

U.S. Pat. No. 5,853,306, which issued to Worth et al. on Dec. 29, 1998, describes an operation of marine engines. It discloses a method of operation of a marine engine which comprises sensing an operator demand for a gear-shift and, in response to the sensing of the operator command, varying the engine torque profile to enable the gear-shift. Typically, the engine torque profile is required to be varied to overcome forces resistive to gear-shift.

U.S. Pat. No. 4,262,622, which issued to Dretzka et al. on Apr. 21, 1981, describes a marine propulsion device including ignition interruption means to assist transmission shifting. The device and apparatus and methods are disclosed for assisting transmission shifting. The marine propulsion device includes an internal combustion engine and a reversing transmission having a pair of bevel gears and a clutch dog moveable between a neutral position out of engagement with the bevel gears and forward and reverse drive positions in full engagement with one of the bevel gears. The marine propulsion device also includes a shift assistance arrangement included in a shift mechanism for axially moving the clutch dog between the neutral and drive positions, and which includes a load sensing lost motion shift lever arrangement having a first switch which is actuated when the resistance to axially moving the clutch dog into a drive position exceeds an upper limit. The shift assistance arrangement also includes an ignition interruption circuit responsive to actuation of the first switch for selectively interrupting the ignition of the internal combustion engine to reduce the engine torque transmitted to the bevel gears to effect relative angular displacement of the clutch dog and the bevel gears to thereby assist the shift mechanism in moving the clutch dog into and out of a drive position.

U.S. Pat. No. 6,470,852, which issued to Kanno on Oct. 29, 2002, describes an engine control system that includes an improved construction that can release an engine from an abnormal engine speed so that, for example, the operator can operate a shift actuator without any overload. The engine includes an air induction system that introduces air to the combustion chamber and includes a throttle valve. The throttle valve admits the air to flow through the air induction system unless placed in a closed position. The throttle valve position sensor is arranged to sense the position of the throttle valve. In one operating mode, the slowdown control is made when the throttle position signal indicates that the throttle valve is generally at the closed position and the speed signal indicates that the engine speed exceeds a preset speed.

U.S. Pat. No. 5,692,992 which issued to Arvidsson et al. on Dec. 2, 1997, describes a shift assist and engine interrupter apparatus. The shift assist apparatus for a marine drive includes a tube having a pair of biased springs, between which a sleeve at the end of a transmission cable is moveably retained. A remote control cable is fixedly attached to the tube. High transmission cable shift forces associated with resistance to shifting cause the sleeve to move against the bias of one of the springs. A sensor detects this movement and sends an electrical signal to interrupt the engine ignition circuit, thereby preventing the firing of one or more cylinders of the engine.

U.S. Pat. No. 5,403,246, which issued to Umemoto on Apr. 4, 1995, describes a control device for an internal combustion engine. The device comprises a shift lever position detector for detecting a shift lever position of an engine for an outboard motor and an ignition timing controller for retarding an ignition timing of the engine for the outboard motor based on the shift lever position when a clutch is disengaged.

U.S. Pat. No. 5,827,150, which issued to Mukumoto on Oct. 27, 1998, describes an engine control having shift assist with fuel injected during ignition cutoff while shifting. The system includes an arrangement for slowing the speed of the engine by disabling certain cylinders in the event of an abnormal engine running condition. Also, an arrangement is provided for slowing the speed of the engine if a change speed transmission for driving the propulsion shaft by the engine offers more than a predetermined resistance to shifting. The controls are interrelated so that the engine protection control predominates. That is, if the engine is in protection control mode and the operator attempts a shift and more than a predetermined resistance is felt, the shift control routine will not be initiated to effect any additional engine speed reduction.

U.S. Pat. No. 4,843,914, which issued to Koike on Jul. 4, 1989, describes a shift assisting device for a marine propulsion unit. Several embodiments of shift assisting devices for marine propulsion units are described, wherein the torque of the engine is reduced if there is resistance to shifting by reducing the amount of fuel supply to the engine. Embodiments are depicted and described wherein this is done by throttling the intake charge or reducing the supply of fuel supplied by a fuel injection nozzle and the principle is applied to either spark ignited or diesel engines.

U.S. Pat. No. 4,938,189, which issued to Morita et al. on Jul. 3, 1990, describes an automatic ignition control system which comprises an ignition circuit of capacitor charge-discharge type. The ignition timing is determined by controlling the charge-discharge cycle of a capacitor by an output signal from an engine speed detection circuit. An overspeed control circuit stops the ignition when a detection output signal of the engine speed detection circuit exceeds a reference voltage level corresponding to a set engine speed. A slowing down control circuit is actuated in response to an engine slowing down operation start switch for realizing a hypothetical condition substantially equivalent to the one in which the engine speed detection circuit detects an engine speed higher than the actual engine speed thereby to accomplish engine slowing down operation by increasing the reference voltage level gradually or increasing the output signal level of the engine speed detection circuit stepwise.

U.S. patent application Ser. No. 09/997,124 which was filed on Nov. 28, 2001, describes a shift assist system for an outboard motor. The system regulates the torque of the engine to ensure proper effortless shifting. The system recognizes open circuit or short circuit faults and nevertheless enables the torque of the engine to be reduced to facilitate easy gear selection.

U.S. Pat. No. 6,647,956, which issued to Sharpton on Nov. 18, 2003, discloses a sound attenuating system for a marine engine. A sound attenuator is provided for an idle air control valve system in order to reduce noise emanating from the idle air control valve. The sound attenuator comprises a fibrous pad that is inserted into an air conduit of the idle air control system. In a preferred embodiment, the fibrous pad is inserted into the air conduit near the air inlet where the conduit receives air from a region upstream, or above the throttle plate. A small hole can be provided through the air inlet. In certain embodiments, the air inlet of the air conduit is an opening formed in an inner cylindrical surface of the throttle body. In alternative embodiments, the air inlet can be remote from the internal surface of the throttle body.

The patents described above are hereby expressly incorporated by reference in the description of the present invention.

It would be significantly beneficial if a marine propulsion system could be provided with an engine control system that controls the idle speed of the engine, prior to an imminent shift event from neutral to either forward or reverse gear, in such a way that the idle speed is slowed in most conditions to minimize the impact of an engagement of the clutch. Whether the clutch is a cone clutch or a dog clutch, proper control of the idle speed will minimize the impact shock and noise associated with a shifting event from neutral to either forward or reverse gear positions. The idle speed can be decreased or increased in anticipation of a shift event, depending on whether the marine vessel is stationary or in the process of being rapidly shifted from forward to reverse or vice versa.

SUMMARY OF THE INVENTION

A method for controlling an engine of a marine propulsion system, according to a preferred embodiment of the present invention, comprises the steps of sensing an impending shift event from a neutral gear position and determining a desired engine operating speed during the shift event. It also comprises the step of changing the operating speed of the engine to the desired engine operating speed, in response to the impending shift event, by performing a step selected from the group consisting of changing the ignition timing of the engine and changing the status of the idle error control valve.

The present invention can perform the sensing step by a neutral position switch, a potentiometer, a non-contact position sensor, or a magnetoelastic sensor. In a preferred embodiment of the present invention, the desired engine operating speed during the shift event is determined as a function of engine temperature. The engine temperature, in turn, is determined by measuring the coolant temperature of the engine. The invention can further comprise the step of determining a speed of the marine vessel on which the marine propulsion system is operating and selecting the operating speed of the engine during the shift event as a function of the speed of the marine vessel.

In certain applications and embodiments of the present invention, the step of changing the ignition timing comprises the step of retarding the ignition timing. The changing step can comprise the step of decreasing the desired engine operating speed during the shift event or, alternatively, increasing the desired engine operating speed during the shift event.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
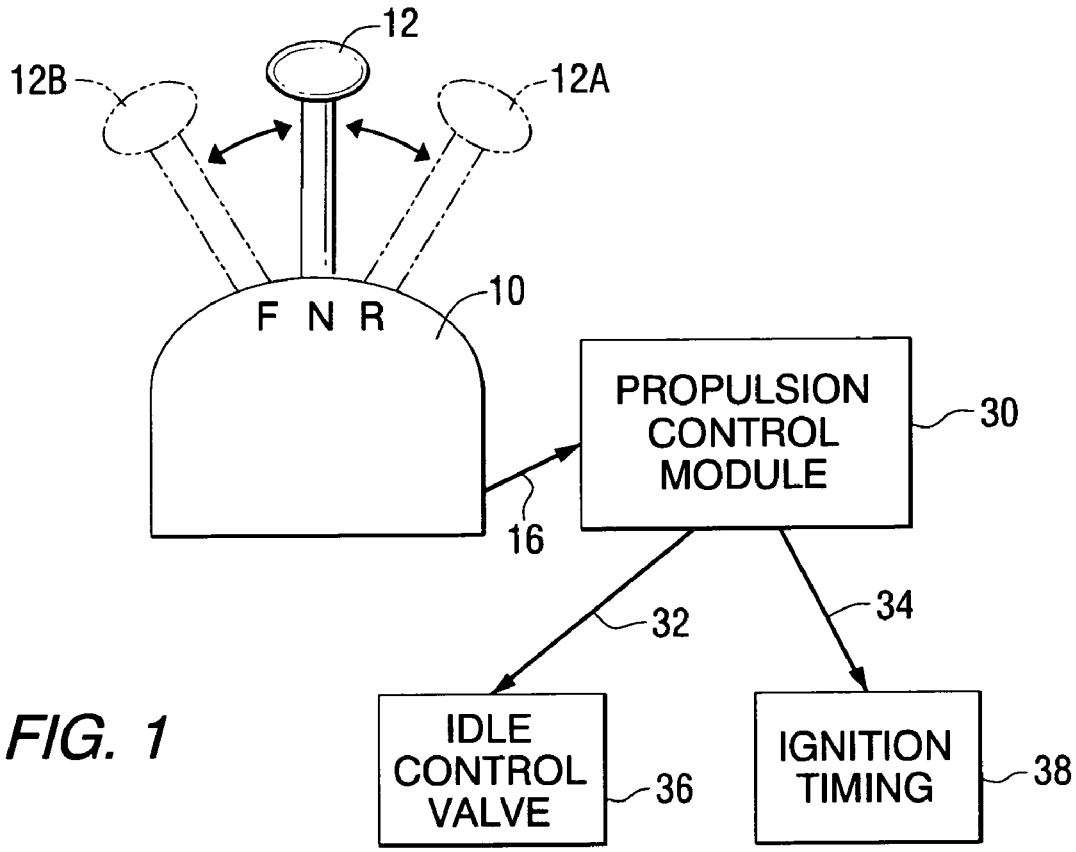
FIG. 1 is a schematic representation of a throttle control mechanism and associated control modules.

Throughout the description of the preferred embodiment of the present invention, like components will be identified by like reference numerals.

It is generally known to those skilled in the art that marine propulsion systems exhibit vibration and noise during a shift from neutral to either forward or reverse gear because of the impact of the clutch engaging at the instant when the shifting event occurs. This vibration and noise occurs whether the clutch is a cone clutch or a dog clutch. It is also generally known that engine control strategy can be used to lessen the noise when a marine propulsion transmission is shifted from either forward or reverse gear into neutral gear position. Typically, this is accomplished by interrupting the spark to one or more cylinders in order to slow the operating speed of the engine during the shifting event in which the transmission is moved into the neutral gear position from either the forward gear position or the reverse gear position.

The present invention, on the other hand, is intended for application during a shift event in which the transmission is shifted from a neutral gear position into either a forward or reverse gear position. In order to control the idle speed of the engine during the shift event, the present invention alters the ignition system timing and/or the amount of air provided to the engine through the idle air control valve. The present invention does not incorporate an interruption of the spark to any of the cylinders of the engine. As will be described in greater detail below, the control of the engine idle speed during the shift event is performed as a function of the speed of the marine vessel in which the marine propulsion system is operating and the temperature of the engine.

FIG. 1 is a schematic representation of a system in which a manually moveable throttle control 10 is provided to allow an operator of a marine vessel to change the operating speed of an engine of the marine propulsion system and the direction of rotation of the propeller shaft. As an example, when the throttle handle 12 is in a central position, the transmission of the marine propulsion system is in a neutral gear position. When the throttle handle 12 is moved into the position identified by reference numeral 12A in FIG. 1, the marine propulsion system is in a reverse gear position and the engine is commanded to operate at wide open throttle. The wide open throttle position represented by the handle 12A in FIG. 1 occurs when the handle is moved approximately 90 degrees from its central position. The position identified by reference numeral 12B in FIG. 1 represents the throttle mechanism being placed in forward gear and commanding a wide open throttle speed of the engine. Typically, the angular difference between the handle identified by reference numeral 12 and that identified by reference numeral 12B is approximately 90 degrees.

In a typical application of a throttle control mechanism 10, the neutral gear position is associated with the handle 12 being within 15 degrees of its central position as shown in FIG. 1. As the handle 12 moves out of that central position, the transmission of the marine propulsion system is commanded to move either into a forward gear position or reverse gear position, depending on the direction of movement of the handle 12. Movement of the handle 12 out of its neutral range is typically sensed by the actuation of a switch or other type of sensor. The neutral position switch provides a signal to a microprocessor that allows the microprocessor to react to the impending gear shift event. As the handle 12 moves farther away from its central position, a speed signal is provided to the microprocessor which represents the commanded engine operating speed. In a typical application of the present invention, for example, a potentiometer is used to indicate the actual position of the handle 12. In one embodiment, the potentiometer provides a signal that can range from its lowest magnitude when the handle 12 is in the reverse position 12A to a maximum output when the handle is in the maximum forward position 12B. This relationship is illustrated graphically in FIG. 2.

Figure 2:
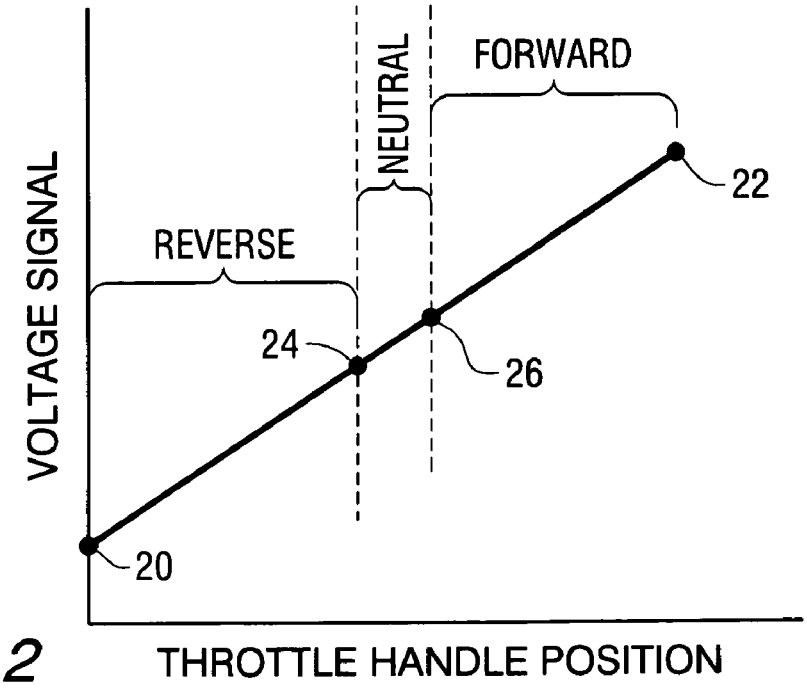
FIG. 2 is a graphical representation of the relationship between the position of the throttle handle and a voltage signal provided to a propulsion control module.

With reference to FIGS. 1 and 2, the output signal from the throttle control system 10, on line 16, would provide a minimum voltage output at point 20 of approximately 0.75 volts. When the handle 12 is moved into its maximum forward position, as identified by reference numeral 12B in FIG. 1, the voltage output on line 16 would be approximately 4.25 volts, as represented by point 22 in FIG. 2. The neutral range is generally represented by output signals between 2.0 volts, at point 24, and 3.0 volts at point 26. In this way, the propulsion control module 30 can determine the position of the handle 12 by receiving a corresponding representative voltage signal on line 16.

With continued reference to FIGS. 1 and 2, it can be seen that a change in output signal on line 16, even if the magnitude of the signal remains between points 24 and 26, can be used to detect an impending shift event as the handle moves within its neutral zone, but toward either a forward gear shift position or reverse gear shift position.

In a preferred embodiment of the present invention, the propulsion control module 30 provides output signals, on lines 32 and 34, to an ignition control valve 36 and an ignition timing circuit 38. The present invention can use either the ignition timing circuit 38 or the idle control valve 36 to change the idle speed of the engine. In addition, both of these devices can be used in coordination with each other to control the idle speed of the engine.

Figure 3:
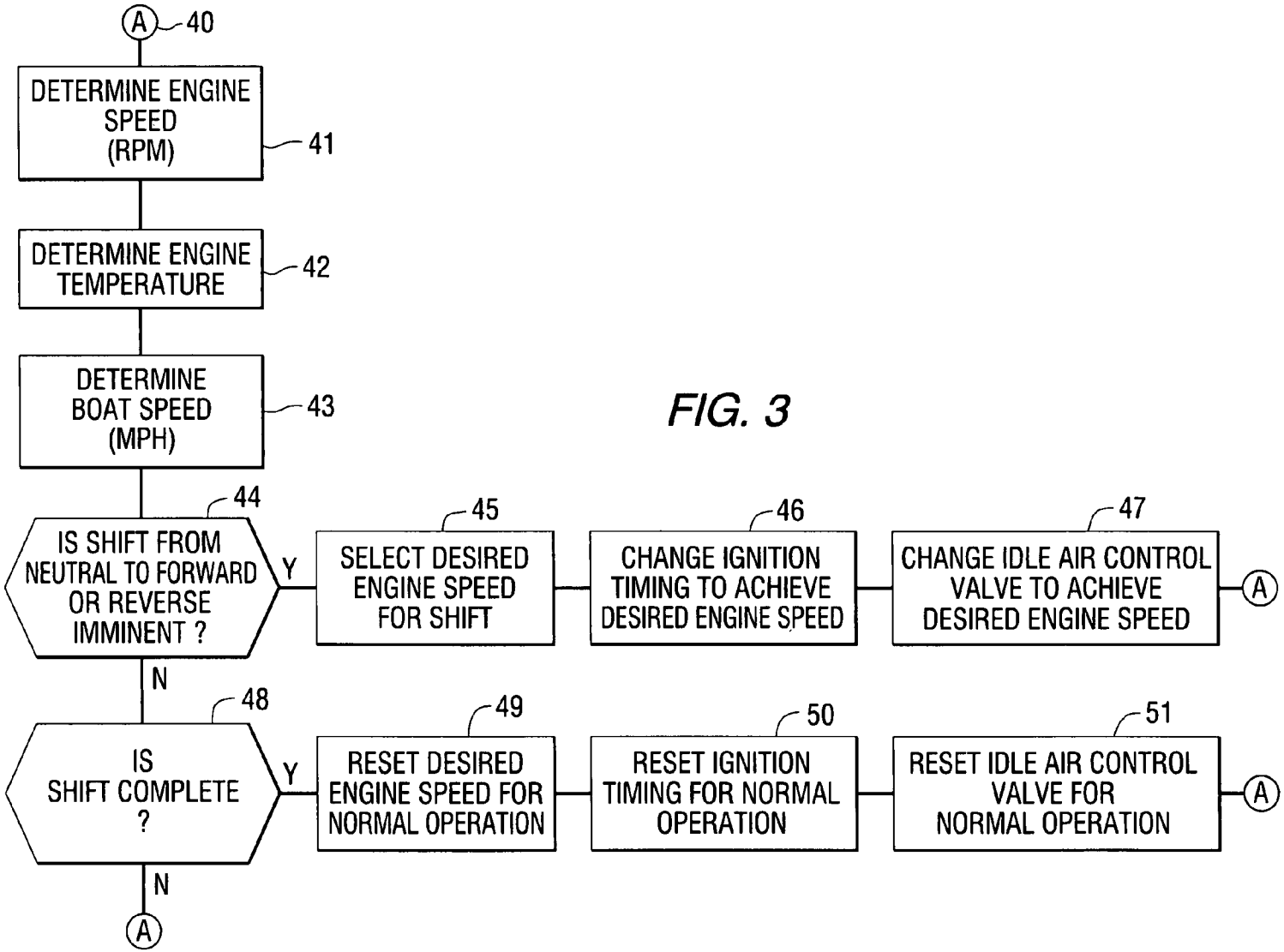
FIG. 3 is a generalized flowchart showing the basic steps of the present invention.

FIG. 3 is a simplified flowchart of the basic steps taken by the present invention to control the engine of a marine propulsion system. Beginning at point 40 in FIG. 3, the present invention determines the engine operating speed at functional block 41, the engine temperature at functional block 42, and the boat speed at functional block 43. The engine operating speed can be determined through the use of a tachometer-like device which can incorporate a gear tooth sensor or other suitable device. The engine temperature can be determined by providing a temperature sensor in thermal communication with the coolant used in an engine. The boat speed can be determined either by actual measurement or, as in a preferred embodiment of the present invention, a calculation that is based on engine speed.

With continued reference to FIG. 3, at functional block 44 the present invention determines whether or not a shift event is imminent. If it is, the present invention selects a desired engine speed for the expected shift event at functional block 45. In one embodiment of the present invention, the step identified by functional block 45 comprises the step of mathematically altering a desired engine speed setting that is used by various algorithms in the propulsion control module 30 to change the operating speed through the use of various methods which include altering the engine's ignition timing and the status of the idle air control valve. Functional block 46 represents the action taken to change the ignition timing in order to achieve the desired engine speed that was determined or selected at functional block 45. Functional block 47 describes the change of the status of the idle air control valve in order to achieve the desired engine speed selected at functional block 45. When this is done, the flowchart returns to the initial point identified by reference numeral 40.

If the answer to the query of functional block 44 is negative, the present invention determines whether or not a shift has been completed. This is identified at functional block 48. If it is completed, the desired engine speed is reset to its normal value at functional block 49, the ignition timing is reset to its normal value at functional block 50, and the idle air control valve is reset to its normal status at functional block 51. With reference to FIGS. 1, 2 and 3, it should be understood that the shift event typically is completed in a very short period of time. As the operator manually moves the handle from a neutral position 12 to either a reverse or forward position, 12A or 12B, a shift event occurs as the throttle handle moves out of its neutral zone described above. When this movement is completed, control of engine speed is accomplished by the position of the throttle handle 12 and no longer controlled by the present invention. Therefore, it should be understood that the present invention is intended to control the idle speed during the period of time when the throttle handle 12 is in the neutral zone and, occasionally, while the throttle handle 12 begins to move out of the neutral zone into either the forward gear position zone or the reverse gear position zone. When the handle 12 is out of the neutral gear position zone, control of the engine is maintained by the position of the throttle handle and the output signal, on line 16, which is graphically represented in FIG. 2.

Figures 4, 5, 6:
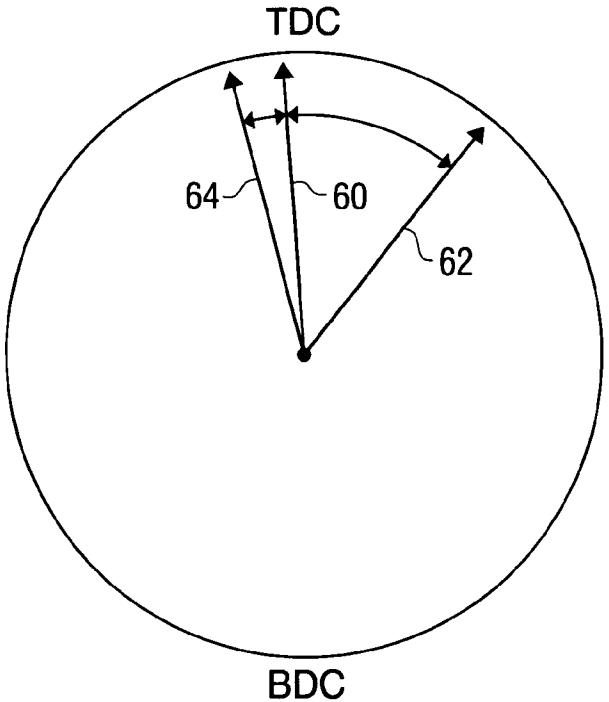
FIG. 4 is a timing diagram showing the normal timing function in comparison to a timing function used to slow the engine and a timing function used to increase the engine operating speed.
FIG. 5 is a graphical representation of a data array representing idle speed as a function of engine temperature.
FIG. 6 is a graphical representation of a data array which represents an offset to idle speed as a function of boat speed.

FIG. 4 is a schematic representation of the ignition timing for an engine. The top dead center (TDC) and bottom dead center (BDC) positions are identified for reference. Arrow 60 represents a typical ignition timing position that is used when the engine is operating at idle speed. Under certain conditions, such as a normal shift from the neutral gear position to either forward or reverse gear positions while the marine vessel is stationary, this procedure typically calls for a reduction in the idle speed of the engine in order to reduce the impact within the transmission during the shift event. By slowing the operation of the engine, the torque being transferred through the drive train is reduced and the resulting shock load within the transmission is decreased. As described above, the slowing of the engine operating speed is accomplished, in a preferred embodiment of the present invention, by a change in the ignition timing from the position represented by arrow 60 in FIG. 4 to the position represented by arrow 62. This is generally accompanied by a corresponding change in the status of an idle air control valve to decrease the amount of air passing into the engine. The reduction in the engine idle speed is normally beneficial when the transmission is being shifted from a neutral gear position to either a forward or reverse gear position when the marine vessel is stationary. However, it should be understood that a different action can be called for when a similar shift is being made while the marine vessel is moving.

In certain situations, the operator of a marine vessel may desire to rapidly change the transmission from a reverse gear position to a forward gear position or vice versa. This can occur during docking procedures. In other words, if the operator of the marine vessel detects that it is necessary to immediately stop the movement of the marine vessel and reverse the movement in a very short period of time to avoid a collision or to maneuver the boat into a docking position, it is more beneficial to increase the engine idle speed during the shift event as the throttle handle is moved through a neutral zone. This is done to avoid stalling the engine. In other words, it should be understood that the present invention is intended for use in situations where the boat is stationary and also in situations where the boat is moving. Although these situations require different engine idle speeds, both are accommodated through the use of the present invention.

In FIG. 4, arrow 64 represents the timing when the present invention desires to increase the engine idle speed, such as a rapid shifting event while the marine vessel is moving. When the ignition timing is changed to the position represented by arrow 64, a corresponding change in the status of the idle air control valve is used to increase the amount of air passing into the engine.

For purposes of reference, the normal ignition timing represented by arrow 60 is approximately 5 degrees before top dead center (BTDC), the ignition timing represented by arrow 62 is 10 degrees after top dead center (ATDC), and the ignition timing represented by arrow 64 is 15 degrees after top dead center (ATDC).

With reference to FIG. 3, it should be understood that the action represented in functional block 45, where the desired engine speed for the shift is selected, this selection is made as a function of both boat speed which is determined at functional block 43 and engine temperature which is determined at functional block 42. An initial determination of desired engine speed for the shift event is made based on engine temperature. In other words, if the engine is cold, which indicates a short period of operation, the desired idle speed can be increased slightly to avoid stalling. On the other hand, if the engine temperature is relatively high, stalling is not a primary concern and the engine idle speed can be lowered from its preliminary desired value. In addition, this preliminary desired boat speed can be altered as a function of boat speed. As described above, the idle speed would be lowered when the boat is stationary and raised when the boat is moving. Alternatively, a data matrix can be used in which engine idle speeds are stored as a dual function of boat speed and engine temperature. This allows the propulsion control module to select the desired engine idle speed from a stored table in which the engine idle speeds are stored as a function of both boat speed and engine temperature.

In one embodiment of the present invention, the desired engine idle speed is stored, as a plurality of individual values, as a function of engine temperature. This is represented in FIG. 5 which shows a one dimensional data array that stores nine engine idle temperatures as a function of nine values of engine temperature. This storage of information allows the propulsion control module to initially select a desired engine idle speed based on a measured engine temperature which is typically determined by measuring the temperature of the engine's coolant. Subsequent to determining the desired idle speed as a function of engine temperature, as represented in FIG. 5, the present invention determines a desired adjustment to the idle speed value based on boat speed. Typically, the values stored in the twenty element array shown in FIG. 6 represent offsets to the values determined in the procedure described above in conjunction with FIG. 5. In other words, the value stored in the array shown in FIG. 6 would be added to or subtracted from the magnitudes selected from the buffer shown in FIG. 5.

Although the present invention has been described with considerable specificity and illustrated to show a preferred embodiment, it should be understood that alternative embodiments are also within its scope.

We claim:

1. A method for controlling an engine of a marine propulsion system, comprising the steps of:

sensing an impending shift event from a neutral gear position;

determining a desired engine operating speed during said shift event; and changing the operating speed of said engine to said desired engine operating speed, in response to said impending shift event, by performing a step selected from the group consisting of changing the ignition timing of said engine and changing the status of an idle air control valve, said desired engine operating speed during said shift event being determined as a function of engine temperature.

2. The method of claim 1, wherein:

said sensing step is performed by a neutral position switch.

3. The method of claim 1, wherein:

said sensing step is performed by a potentiometer.

4. The method of claim 1, wherein:

said sensing step is performed by a magnetoelastic sensor.

5. The method of claim 1, wherein:

said engine temperature is determined by measuring the coolant temperature of said engine.

6. The method of claim 1, further comprising:

determining a speed of a marine vessel on which said marine propulsion system is operating.

7. The method of claim 6, wherein:

said desired engine operating speed during said shift event is selected as a function of said speed of said marine vessel.

8. The method of claim 1, wherein:

said step of changing the ignition timing comprises the step of retarding the ignition timing.

9. The method of claim 1, wherein:

said changing step comprises the step of decreasing said desired engine operating speed during said shift event.

10. The method of claim 1, wherein:

said changing step comprises the step of increasing said desired engine operating speed during said shift event.

11. A method for controlling an engine of a marine propulsion system, comprising the steps of:

determining a speed of a marine vessel on which said marine propulsion system is operating;

sensing an impending shift event from a neutral gear position;

determining a desired engine operating speed during said shift event, as a function of said speed of said marine vessel, by performing a step selected from the group consisting of changing the ignition timing of said engine and changing the status of an idle air control valve; and changing the operating speed of said engine, in response to said impending shift event, to said desired engine operating speed during said shift event, said operating speed changing step comprising the alternative steps of decreasing the operating speed of said engine when said speed of said marine vessel is below a first predetermined threshold speed and increasing the operating speed of said engine when said speed of said marine vessel is above a second predetermined threshold speed.

12. The method of claim 11, further comprising:

determining a desired operating speed of said engine as a dual function of engine temperature and said speed of said marine vessel.

13. The method of claim 12, wherein:

said engine temperature is determined by measuring the coolant temperature of said engine.

14. The method of claim 11, wherein:

said step of changing the ignition timing comprises the step of retarding the ignition timing.

15. The method of claim 14, wherein:

said changing step comprises the step of decreasing said desired engine operating speed during said shift event.

16. A method for controlling an engine of a marine propulsion system, comprising the steps of:

determining a speed of a marine vessel on which said marine propulsion system is operating;

measuring a temperature of said engine;

selecting a desired engine operating speed during said shift event as a function of said temperature of said engine and said speed of said marine vessel;

sensing an impending shift event from a neutral gear position; and changing the operating speed of said engine to said desired engine operating speed during said shift event, in response to said impending shift event, by performing a step selected from the group consisting of changing the ignition timing of said engine and changing the status of an idle air control valve.

17. The method of claim 16, wherein:

said engine temperature is determined by measuring the coolant temperature of said engine.

18. The method of claim 17, wherein:

said step of changing the operating speed of said engine to said desired engine operating speed during said shift event comprises the steps of changing the ignition timing of said engine and changing the status of an idle air control valve.

* * * * *